US006793188B1

(12) United States Patent
Carlin et al.

(10) Patent No.: US 6,793,188 B1
(45) Date of Patent: Sep. 21, 2004

(54) BOOK RETENTION DEVICE

(75) Inventors: Glenn Carlin, Kent, CT (US); Gilbert Aviles, Accord, NY (US)

(73) Assignee: Crew Design Incorporated, Kent, CT (US)

( * ) Notice: Subject to any disclaimer, the term of this patent is extended or adjusted under 35 U.S.C. 154(b) by 0 days.

(21) Appl. No.: 10/409,242

(22) Filed: Apr. 8, 2003

(51) Int. Cl.[7] ..... A47B 97/04

(52) U.S. Cl. ..... 248/450; 248/448; 248/451; 281/43

(58) Field of Search ..... 248/450, 451, 248/441.1, 447, 448, 317; 281/43, 45

(56) References Cited

U.S. PATENT DOCUMENTS 869,379 A * 10/1907 Mills ..... 248/690
1,285,939 A * 11/1918 Cherry ..... 248/691
2,059,679 A * 11/1936 Burton ..... 248/447
4,395,057 A * 7/1983 Young ..... 281/42
4,652,013 A * 3/1987 Azzato ..... 281/46
4,898,406 A * 2/1990 Willius ..... 281/43

* cited by examiner

*Primary Examiner*—Ramon O Ramirez
(74) *Attorney, Agent, or Firm*—McCormick, Paulding & Huber LLP

(57) ABSTRACT

A book retention device comprises a sleeve for accommodating a book with a binder hole extending therethrough. The sleeve includes a first side cover, a second side cover, and a back cover. The sleeve defines a hole for being placed in registration with the binder hole of the book. A suspending member has a first end for being secured to an external mounting surface, and a second end defining a hole for being placed in registration with the hole defined by the sleeve. The hole of the sleeve and the hole of the suspending member cooperate to permit a fastener to be received through the holes of the suspending member, the sleeve, and the book for securing the book to the external mounting surface and for permitting the sleeve and book accommodated therein to pivot relative to the suspending member in order to adjust the position of the book.

18 Claims, 4 Drawing Sheets

BOOK RETENTION DEVICE

FIELD OF THE INVENTION

This invention relates generally to retention devices for books, and more particularly to devices for protecting and preventing books, parts catalogs and the like from being taken from a location such as a store.

BACKGROUND OF THE INVENTION

Parts catalogs or other types of reference books are frequently placed in a designated public location, such as a store, and are suspended from and attached to a wall or shelf by string, rope or other types of fasteners. The fasteners slightly minimize the risk of the book being stolen or otherwise taken from the designated location. However, such fasteners are typically inadequate for preventing books from being stolen. Moreover, the repeated lifting of the suspended book, the repeated opening and closing of the book, and the repeated dropping or otherwise releasing of the book into a suspended position accelerates aging or wear on the book. Such books tend to become badly dog-eared, dirty or otherwise unsightly in appearance. Such wear tends to reduce the useful life of the retained book so that the book must be frequently replaced—sometimes at considerable expense to the owner.

In response to the foregoing, it is an object of the present invention to overcome the drawbacks and disadvantages of prior art book retention devices.

SUMMARY OF THE INVENTION

In a first aspect of the present invention, a book retention device comprises a sleeve for accommodating a book with a binder hole extending therethrough. The sleeve includes a first side cover, a second side cover, and a back cover. The sleeve defines at least one hole for being placed in registration with a binder hole of a book accommodated within the sleeve. A suspending member has a first end for being secured to an external mounting surface such as a wall or a shelf, and a second end defining at least one hole for being placed in registration with the at least one hole defined by the sleeve. The at least one hole of the sleeve and the at least one hole of the suspending member cooperate to permit a fastening means to be received through the at least one hole of the suspending member, the at least one hole of the sleeve, and the binder hole of a book to be accommodated within the sleeve for securing the book to the external mounting surface and for permitting the sleeve and book accommodated therein to pivot relative to the suspending member in order to adjust the position of the book.

In a second aspect of the present invention, a book retention device comprises a sleeve for accommodating a book with a binder hole extending therethrough. The sleeve includes a first half portion having a first side cover and a first portion of a back cover, and the sleeve further includes a second half portion having a second side cover and a second portion of the back cover. The first and second half portions of the sleeve respectively define first and second holes being in registration with each other and with a binder hole of a book to be accommodated within the sleeve when the first and second half portions of the sleeve are positioned with respect to one another for accommodating a book therein. A suspending member has a first end for being secured to an external mounting surface, and a second end defining at least one hole for being placed in registration with the first and second holes respectively defined by the first and second half portions of the sleeve. The first and second holes of the sleeve and the at least one hole of the suspending member cooperate to permit a fastening means to be received through the at least one hole of the suspending member, the first and second holes of the sleeve, and the binder hole of a book accommodated within the sleeve for securing the book to the external mounting surface and for permitting the sleeve and book to be accommodated therein to pivot relative to the suspending member in order to adjust the position of the book.

In a third aspect of the present invention, a book retention device comprises a sleeve for accommodating a book with a binder hole extending therethrough. The sleeve includes a first side cover, a second side cover, and a back cover. The sleeve defines at least one hole for being placed in registration with a binder hole of a book accommodated within the sleeve. A suspending member includes a body portion for being secured to an external mounting surface. The suspending member further includes a first leg extending from a first side of the body portion and defining a first hole for being placed in registration with the at least one hole defined by the sleeve, and a second leg extending from a second side of the body portion and defining a second hole for being placed in registration with the at least one hole defined by the sleeve. The at least one hole of the sleeve and the first and second holes of the suspending member cooperate to permit a fastening means to be received through the first and second holes of the suspending member, the at least one hole of the sleeve, and the binder hole of a book accommodated within the sleeve for securing the book to the external mounting surface and for permitting the sleeve and book to be accommodated therein to pivot relative to the suspending member in order to adjust the position of the book.

A first advantage of the present invention is that the sleeve reduces the wear otherwise inflicted on the book caused by repeated and frequent use.

A second advantage of the present invention is that the book is securely retained at a designated location in order to prevent the book from being stolen or otherwise taken.

A third advantage of the present invention is that while still being retained, the position of the book is easily adjustable for the user.

A fourth advantage of the present invention is that the book retention device has an increased the useful life relative to prior fasteners used for retaining books.

Other objects and advantages of the present invention will become apparent in view of the following detailed description and accompanying drawings.

DETAILED DESCRIPTION OF THE PREFERRED EMBODIMENT

Figure 1:
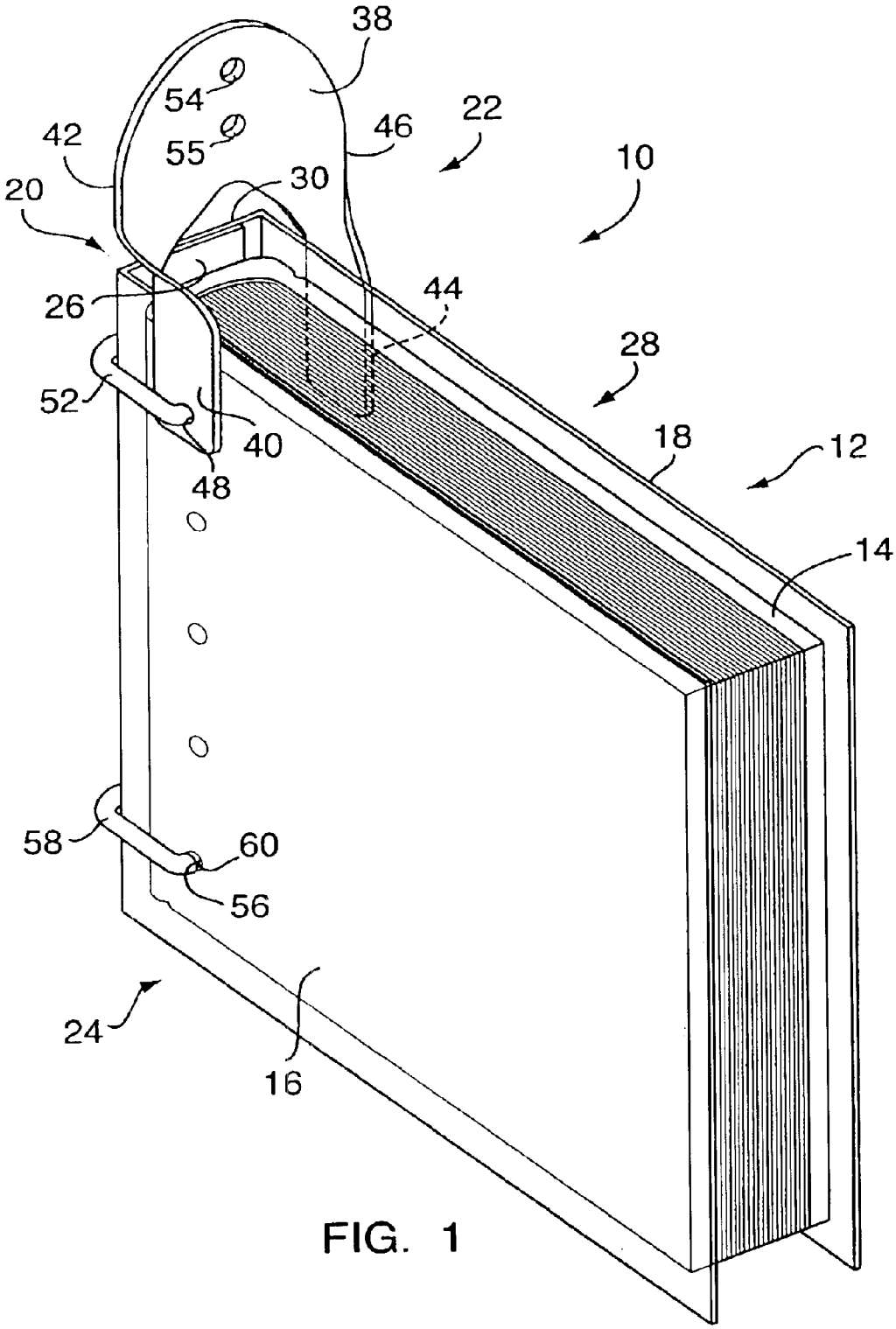
FIG. 1 is a perspective view of a book retention device in accordance with the present invention.
Figure 2:
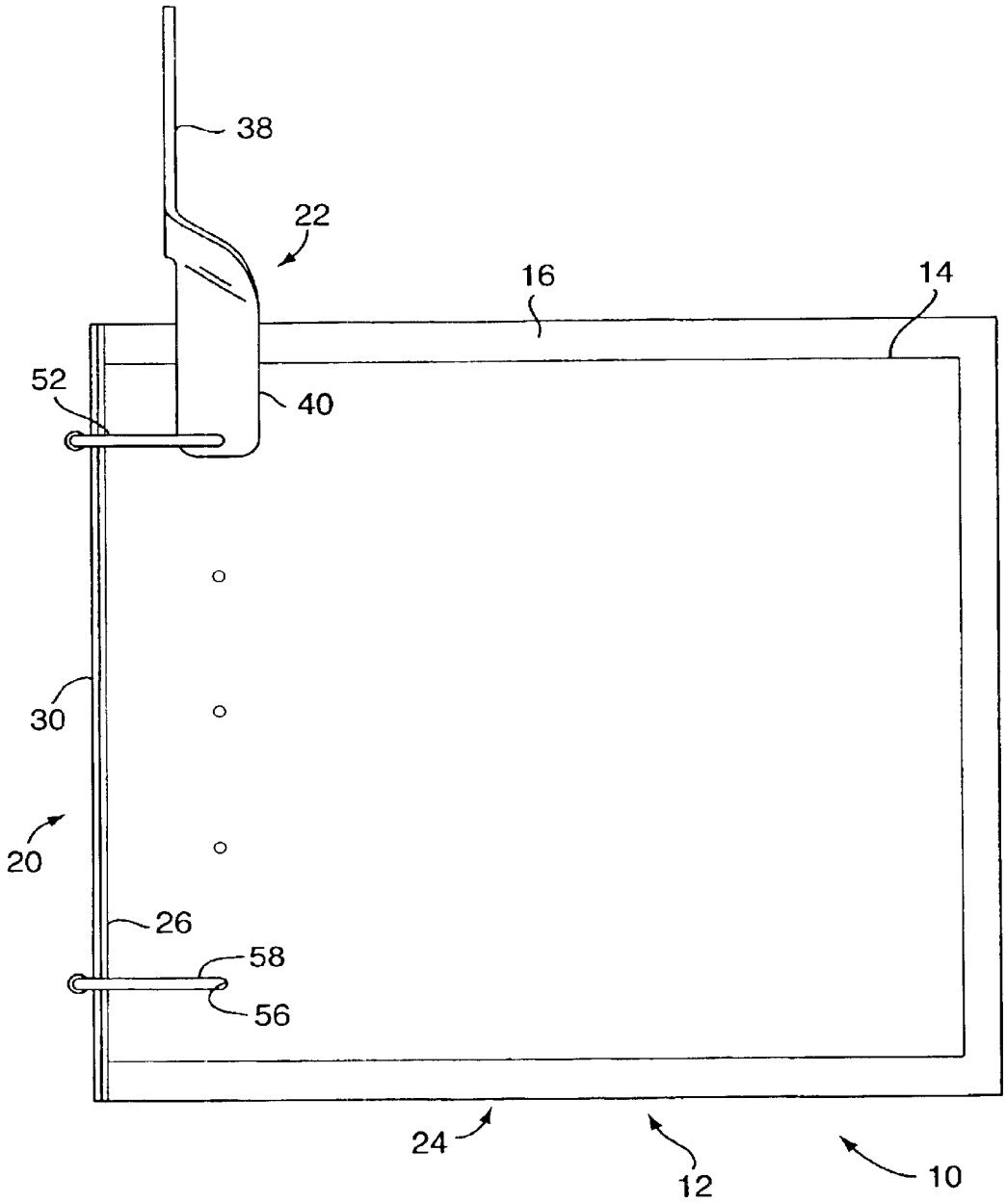
FIG. 2 is a side elevational view of the book retention device of FIG. 1.

With reference to FIGS. 1–7, a book retention device in accordance with the present invention is generally designated by the reference number 10. The book retention device 10 includes a sleeve 12 for accommodating a book 14, such as a parts catalog. The sleeve 12, preferably transparent and made of a durable plastic material such as PVC or PETG, includes a first side cover 16, a second side cover 18, and a back cover 20. A suspending member 22, preferably made of metal for durability and permanence, pivotally attaches the sleeve 12 and the book 14 accommodated therein to an external mounting surface (not shown) such as a wall or shelf to prevent the book from being stolen or otherwise taken from a designated location such as a store. Although the suspending member 22 is preferably made of metal, it should be understood that the suspending member may be made of other durable materials such as plastic without departing from the scope of the present invention.

Figure 4:
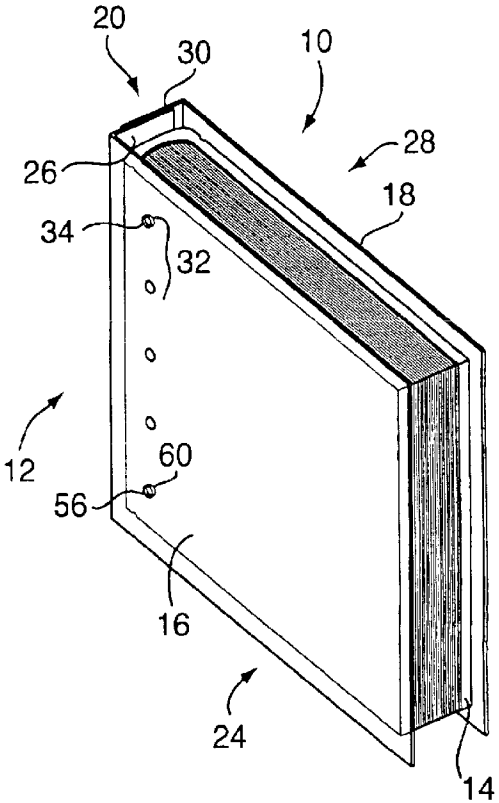
FIG. 4 is a perspective view of the sleeve of the book retention device of FIG. 1 in an assembled state.
Figure 3:
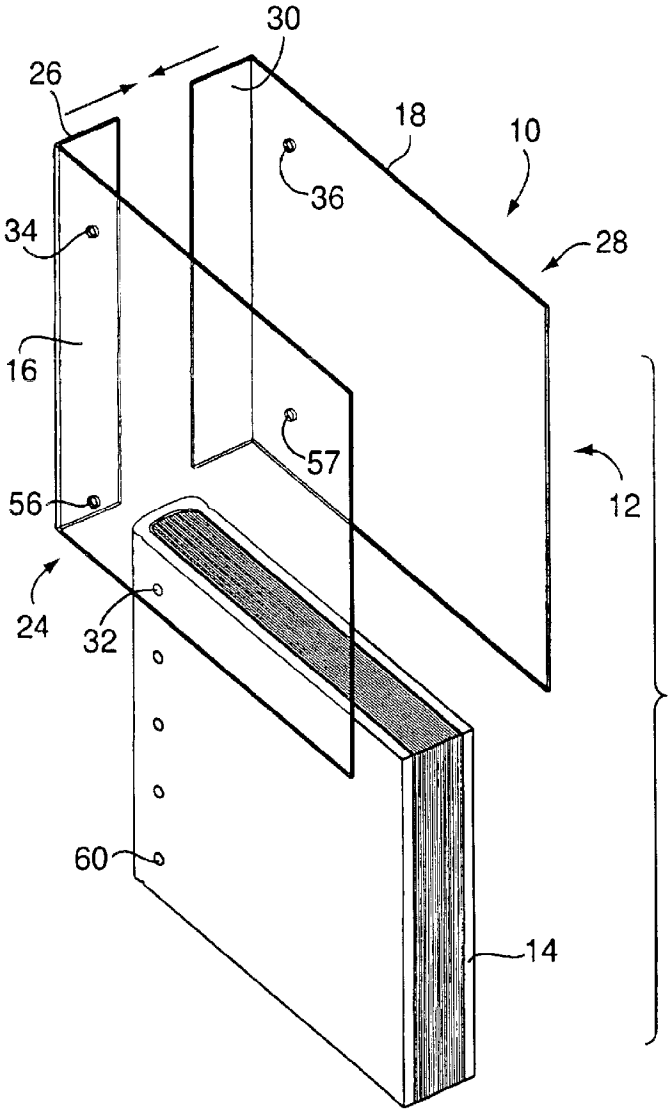
FIG. 3 is a perspective view of the sleeve of the book retention device of FIG. 1 in a disassembled state.
Figure 5:
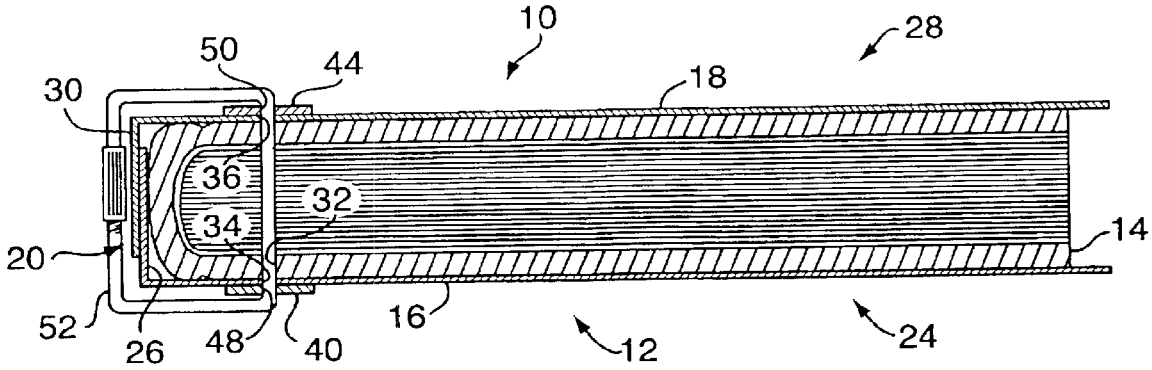
FIG. 5 is a cross-sectional plan view of the book retention device of FIG. 1.

As shown in FIGS. 3 and 4, the sleeve 12 preferably includes a first half portion 24 including the first side cover 16 and a first portion 26 of the back cover 20. The sleeve 12 also includes a second half portion 28 including the second side cover 18 and a second portion 30 of the back cover 20. Preferably, the first half portion 24 and the second half portion 28 of the sleeve 12 are identical in shape, but are not limited in this regard. As shown in FIG. 4, the first half portion 24 and the second half portion 28 are brought together to accommodate a book 14, such as a parts catalog, therebetween. As best shown in FIG. 5, one of the first and second portions 26, 30 of the back cover 20 adjustably overlaps the other portion in order to accommodate books of widths ranging from one to twice the width of a half portion of the back cover 20.

The sleeve 12 defines at least one hole for being placed in registration with a binder hole 32 of the book 14 to be accommodated within the sleeve. As shown in FIG. 3, preferably, the first half portion 24 of the sleeve 12 defines a first hole 34, and the second half portion 28 of the sleeve defines a second hole 36 adjacent to an upper rearward end of the sleeve. The first and second holes 34, 36 are generally in registration with each other when the first half portion 24 and the second half portion 28 of the sleeve 12 are positioned for accommodating a book therein.

Figure 6:
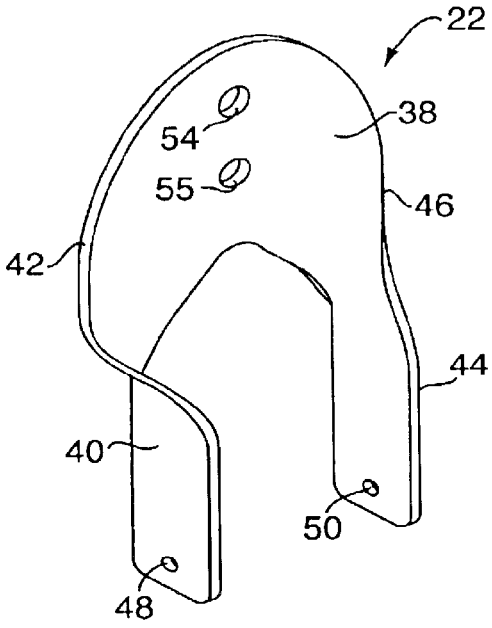
FIG. 6 is a front elevational view of a suspending member of the book retention device of FIG. 1.
Figure 7:
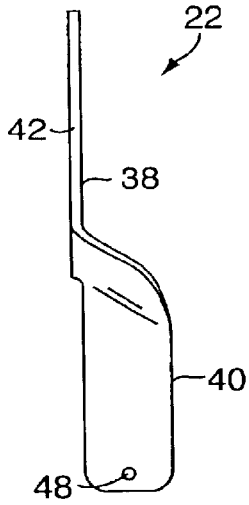
FIG. 7 is a side elevational view of the suspending member of FIG. 6.

As shown in FIGS. 6 and 7, the suspending member 22 preferably includes a body portion 38, a first leg 40 extending downwardly from a first side 42 of the suspending member, and a second leg 44 extending downwardly from a second side 46 of the suspending member. The first and second legs 40, 44 respectively define third and fourth holes 48, 50. The first and second legs 40, 44 are positioned over the sleeve 12 such that the third hole 48 is in registration with the first hole 34 of the first half portion 24 of the sleeve 12, and the fourth hole 50 is in registration with the second hole 36 of the second half portion 28 of the sleeve. A flat surface of each of the first and second legs 40, 44 of the suspending member 22 is preferably in a plane perpendicular or about 90° relative to that of a flat surface of the body portion 38 of the suspending member so that the body portion lies flat against an external mounting surface while the legs lie flat against the sleeve 12. In other words, the upper portion of the first and second legs 40, 44 appears to be twisted ninety degrees with respect to the body portion 38.

A means for securing the suspending member 22 to the sleeve 12 and a book 14 within the sleeve is then inserted within the holes that are in registration. For example, a loop fastener 52 such as rope, string or lockable tie fastener is placed through the third hole 48 of the first leg 40 of the suspending member 22, the first hole 34 of the first half portion 24 of the sleeve 12, the binder hole 32 of the book 14, the second hole 36 of the second half portion 28 of the sleeve, and the fourth hole 50 of the second leg 44 of the suspending member, whereby the book, sleeve and suspending leg are securely coupled to one another.

The body portion 38 of the suspending member 22 preferably defines at least one hole, such as two holes 54, 55 shown in FIGS. 1 and 6, for securing the suspending member to an external mounting surface (not shown) such as a wall or a shelf. For example, bolts, screws or other relatively strong fasteners may be received through the holes 54, 55 to secure the suspending member 22 to the external mounting surface.

As shown in FIG. 3, the first half portion 24 and the second half portion 28 of the sleeve 12 may define additional holes 56, 57 in registration with one another and located adjacent to the rearward, lower end of the sleeve 12 for further attaching a lower end of the book 14 to the sleeve. An additional loop fastener 58 is received through the additional holes 56, 57 and an associated binder hole 60 in the book 14 to ensure that both the top and bottom ends of the book are securely held within the sleeve 12.

In operation, the sleeve 12 generally covers the side and back portions of the book 14 accommodated therein in order to increase the useful life of the book. Repeated lifting of the suspended book, the repeated opening and closing of the book, and the repeated dropping or otherwise releasing of the book into a suspended position otherwise accelerates aging or wear on the book without a protective sleeve. The suspending member 22 provides a durable fastener for pivotally attaching the book 14 to an external mounting surface so that the book is prevented from being stolen or otherwise taken from a designated location. The pivoting action of the suspending member 22 permits the book 14 to be pivoted to a readable position while being maintained at the designated location.

As will be recognized by those of ordinary skill in the pertinent art, numerous modifications and substitutions may be made to the above-described embodiment of the present invention without departing from the scope of the invention as set forth in the appended claims. Accordingly, the preceding portion of this specification is to be taken in an illustrative, as opposed to a limiting sense.

What is claimed is:

1. A book retention device comprising:

a sleeve for accommodating a book with a binder hole extending therethrough, the sleeve including:

a first side cover;

a second side cover; and a back cover, the sleeve defining at least one hole for being placed in registration with the binder hole of the book accommodated within the sleeve; and a suspending member having a first end for being secured to an external mounting surface, and a second end defining at least one hole for being placed in registration with the at least one hole defined by the sleeve, the at least one hole of the sleeve and the at least one hole of the suspending member cooperating to permit a fastening means to be received through the at least one hole of the suspending member, the at least one hole of the sleeve, and the binder hole of a book accommodated within the sleeve for securing the book to the external mounting surface and for permitting the sleeve and book to be accommodated therein to pivot relative to the suspending member in order to adjust the position of the book; wherein the sleeve comprises a first half portion including the first side cover and a first portion of the back cover, and a second half portion including the second side cover and a second portion of the back cover.

2. A book retention device as defined in claim 1, wherein the sleeve is made of a transparent, plastic material.

3. A book retention device as defined in claim 1, wherein the first half portion and the second half portion are generally identical in shape.

4. A book retention device as defined in claim 1, wherein the at least one hole defined by the sleeve includes a first hole defined by the first half portion of the sleeve, and a second hole defined by the second half portion of the sleeve, the first and second holes being in registration with each other when the first half portion and the second half portion of the sleeve are positioned with respect to one another for accommodating a book therein.

5. A book retention device as defined in claim 4, wherein the suspending member includes a body portion, a first leg extending from a first side of the body portion and defining a hole for being placed in registration with the first hole defined by the first half portion of the sleeve, a second leg extending from a second side of the body portion and defining a hole for being placed in registration with the second hole defined by the second half portion of the sleeve.

6. A book retention device as defined in claim 5, wherein the body portion and the first and second legs of the suspending member are generally planar surfaces, the planar surface of the body portion being generally perpendicular to the planar surfaces of the first and second legs.

7. A book retention device as defined in claim 5, wherein the body portion of the suspending member defines at least one hole for receiving means for attaching the suspending member to an external mounting surface.

8. A book retention device comprising:

a sleeve for accommodating a book with a binder hole extending therethrough, the sleeve including a first half portion having a first side cover and a first portion of a back cover, and the sleeve further including a second half portion having a second side cover and a second portion of the back cover, the first and second half portions of the sleeve respectively defining first and second holes being in registration with each other and with a binder hole of a book to be accommodated within the sleeve when the first and second half portions of the sleeve are positioned with respect to one another for accommodating a book therein; and a suspending member having a first end for being secured to an external mounting surface, and a second end defining at least one hole for being placed in registration with the first and second holes respectively defined by the first and second half portions of the sleeve, the first and second holes of the sleeve and the at least one hole of the suspending member cooperating to permit a fastening means to be received through the at least one hole of the suspending member, the first and second holes of the sleeve, and the binder hole of a book accommodated within the sleeve for securing the book to the external mounting surface and for permitting the sleeve and book to be accommodated therein to pivot relative to the suspending member in order to adjust the position of the book.

9. A book retention device as defined in claim 8, wherein the first half portion and the second half portion are generally identical in shape.

10. A book retention device as defined in claim 8, wherein the suspending member includes a body portion, a first leg extending from a first side of the body portion and defining a hole for being placed in registration with the first hole defined by the first half portion of the sleeve, a second leg extending from a second side of the body portion and defining a hole for being placed in registration with the second hole defined by the second half portion of the sleeve.

11. A book retention device as defined in claim 10, wherein the body portion and the first and second legs of the suspending member are generally planar surfaces, the planar surface of the body portion being generally perpendicular to the planar surfaces of the first and second legs.

12. A book retention device as defined in claim 10, wherein the body portion of the suspending member defines at least one hole for receiving means for attaching the suspending member to an external mounting surface.

13. A book retention device as defined in claim 8, wherein the sleeve is made of a transparent, plastic material.

14. A book retention device comprising:

a sleeve for accommodating a book with a binder hole extending therethrough, the sleeve including:

a first side cover;

a second side cover; and a back cover, the sleeve defining at least one hole for being placed in registration with a binder hole of a book accommodated within the sleeve; and a suspending member including a body portion for being secured to an external mounting surface, a first leg extending from a first side of the body portion and defining a first hole for being placed in registration with the at least one hole defined by the sleeve, a second leg extending from a second side of the body portion and defining a second hole for being placed in registration with the at least one hole defined by the sleeve, the at least one hole of the sleeve and the first and second holes of the suspending member cooperating to permit a fastening means to be received through the first and second holes of the suspending member, the at least one hole of the sleeve, and the binder hole of a book accommodated within the sleeve for securing the book to the external mounting surface and for permitting the sleeve and book to be accommodated therein to pivot relative to the suspending member in order to adjust the position of the book; wherein the sleeve comprises a first half portion including the first side cover and a first portion of the back cover, and a second half portion including the second side cover and a second portion of the back cover.

15. A book retention device as defined in claim 14, wherein the at least one hole defined by the sleeve includes a first hole defined by the first half portion of the sleeve, and a second hole defined by the second half portion of the sleeve, the first and second holes being in registration with each other when the first half portion and the second half portion of the sleeve are positioned with respect to one another for accommodating a book therein.

16. A book retention device as defined in claim 14, wherein the body portion and the first and second legs of the suspending member are generally planar surfaces, the planar surface of the body portion being generally perpendicular to the planar surfaces of the first and second legs.

17. A book retention device as defined in claim 14, wherein the body portion of the suspending member defines at least one hole for receiving means for attaching the suspending member to an external mounting surface.

18. A book retention device as defined in claim 14, wherein the first half portion and the second half portion are generally identical in shape.

* * * * *